US008495969B2

(12) United States Patent
Bahnmüller et al.

(10) Patent No.: US 8,495,969 B2
(45) Date of Patent: Jul. 30, 2013

(54) APPARATUS AND METHOD FOR PRODUCING ELECTRICALLY CONDUCTING NANOSTRUCTURES BY MEANS OF ELECTROSPINNING

(76) Inventors: Stefan Bahnmüller, Köln (DE); Andreas Greiner, Amöneburg (DE); Joachim H. Wendorff, Nauheim (DE); Roland Dersch, Marburg (DE); Jacob Belardi, Bergisch Gladbach (DE); Max Von Bistram, Marburg (DE); Stefanie Eiden, Leverkusen (DE); Stephan Michael Meier, Grevenbroich (DE)

( * ) Notice: Subject to any disclaimer, the term of this patent is extended or adjusted under 35 U.S.C. 154(b) by 706 days.

(21) Appl. No.: 12/198,941

(22) Filed: Aug. 27, 2008

(65) Prior Publication Data

US 2009/0130301 A1 May 21, 2009

(30) Foreign Application Priority Data

Aug. 29, 2007 (DE) ..... 10 2007 040 762

(51) Int. Cl.
*B05B 5/00* (2006.01)

(52) U.S. Cl.
USPC ..... 118/713; 118/621; 118/629; 977/892; 264/449; 427/458; 427/466; 427/472

(58) Field of Classification Search
None
See application file for complete search history.

(56) References Cited

U.S. PATENT DOCUMENTS

| | | | | |
|---|---|---|---|---|
| 2001/0045547 | A1 | 11/2001 | Senecal et al. | |
| 2003/0137083 | A1 | 7/2003 | Ko et al. | |
| 2005/0089679 | A1 | 4/2005 | Ittel et al. | |
| 2005/0287366 | A1 | 12/2005 | Okuzaki et al. | |
| 2006/0204539 | A1 * | 9/2006 | Atala et al. | 424/423 |
| 2009/0014920 | A1 | 1/2009 | Belcher et al. | |
| 2009/0233057 | A1 | 9/2009 | Aksay et al. | |
| 2010/0222771 | A1 * | 9/2010 | Mitchell et al. | 606/1 |

FOREIGN PATENT DOCUMENTS

| | | | |
|---|---|---|---|
| JP | 2005-330624 | A | 12/2005 |
| JP | 2007-508418 | A | 4/2007 |
| WO | 01/51690 | A | 7/2001 |
| WO | 2005/033799 | A1 | 4/2005 |
| WO | 2006/001719 | A | 1/2006 |
| WO | 2007/053621 | A1 | 5/2007 |

OTHER PUBLICATIONS

Han, T. et al. "Buckling of jets in electrospinning," Polymer 48 (2007) 6064-6076; available on line Aug. 8, 2007.*

International Search Report dated Apr. 20, 2009, mailed May 19, 2009.

Allen, T., "Particle Size Measurements—Powder Sampling and Particle Size Measurement", Kluver Academic Publishers, vol. 1, Fifth Edition, (1999), pp. 404-411.

Doshi J. et al., "Electrospinning Process and Applications of Electrospun Fibres", Institute of Polymer Science, pp. 1698-1703, (1993).

Kadem et al., "Composite Polymer Nanofibres with Carbon Nanotubes and Titanium Dioxide Particles", Langmuir, vol. 21, No. 12, pp. 5600-5604, May 11, 2005.

* cited by examiner

*Primary Examiner* — Yelena G Gakh
*Assistant Examiner* — Michelle Adams
(74) *Attorney, Agent, or Firm* — Norris McLaughlin & Marcus PA

(57) ABSTRACT

Apparatus and method for producing electrically conducting nanostructures by means of electrospinning, the apparatus having at least a substrate holder (1), a spinning capillary (2), connected to a reservoir (3) for a spinning liquid (4) and to an electrical voltage supply (5), an adjustable movement unit (6, 6') for moving the spinning capillary (2) and/or the substrate holder (1) relative to one another, an optical measuring device (7) for monitoring the spinning procedure at the outlet of the spinning capillary (2), and a computer unit (8) for controlling the drive of the spinning capillary (2) relative to the substrate holder (1) in accordance with the spinning procedure.

14 Claims, 1 Drawing Sheet

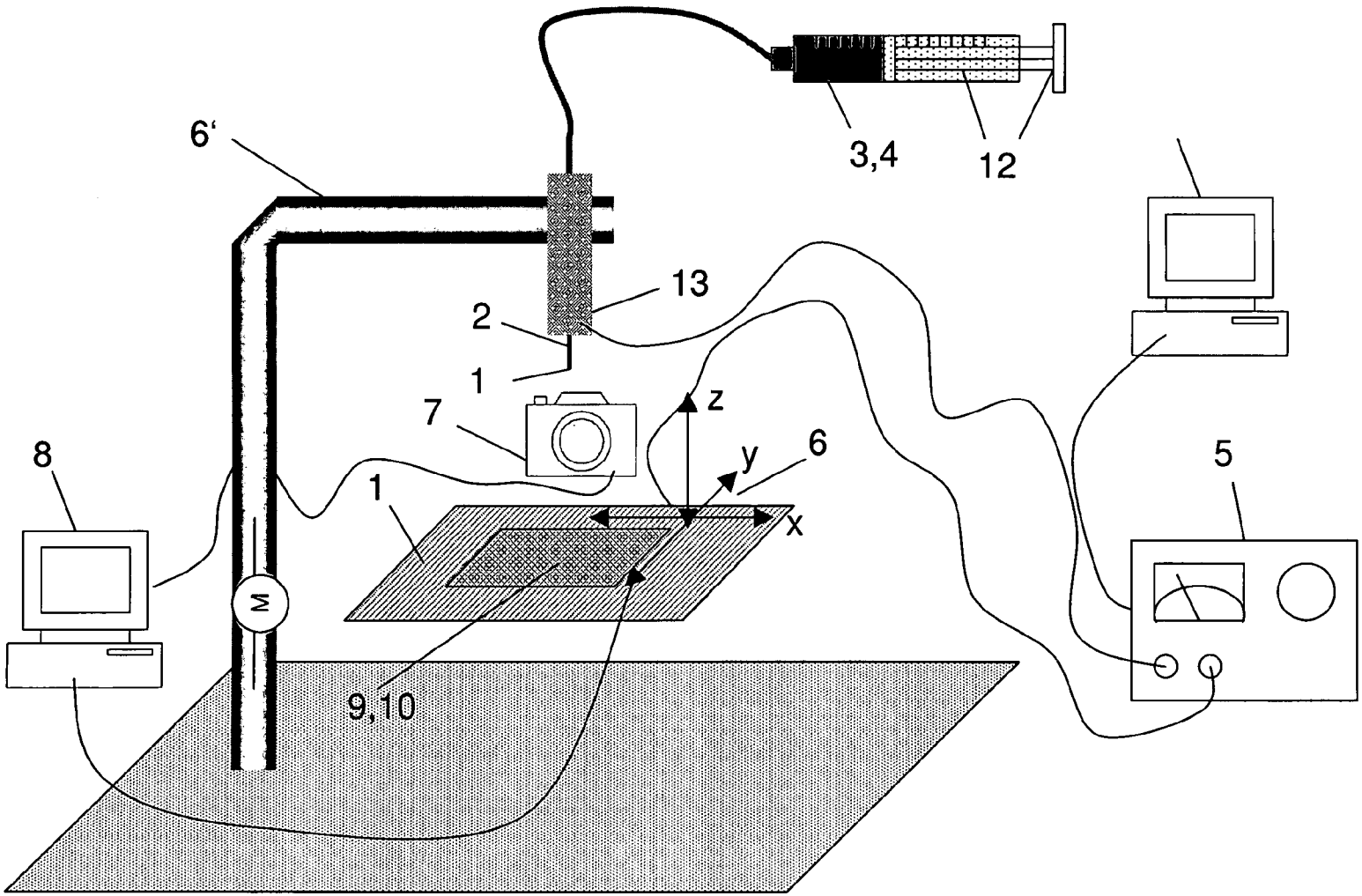
5
12
3,4
13
6
x
y
z
2
1
7
1
9,10
6'
8

APPARATUS AND METHOD FOR PRODUCING ELECTRICALLY CONDUCTING NANOSTRUCTURES BY MEANS OF ELECTROSPINNING

The present invention starts from known methods for the production of structures of electrically conducting material using printing methods. The invention relates to a method by means of which it is possible to deposit nanofibres in a targeted manner with a high spatial precision onto any desired surface. This is made possible by a specially adapted process of so-called electrospinning in conjunction with a material suitable for this purpose, from which the electrically conducting structures are formed, wherein the structures consist of electrically conducting particles or are subjected to a post-treatment in order to impart conductivity.

BACKGROUND OF THE INVENTION

Many structural parts (e.g. many internal fittings of automobiles; discs) and objects of daily use (e.g. beverage bottles) consist substantially of electrically insulating materials. This includes known polymers, such as polyvinyl chloride, polypropylene etc., but also ceramics, glass and other mineral materials. In many cases the insulating effect of the structural part is desired (e.g. in the case of housings of portable computers). However, there is often also a need to apply an electrically conducting surface or structure to such structural parts or objects, in order for example to integrate electronic functions directly into the structural part or the object.

Further requirements placed on the surface of articles of daily use and their material include as great an artistic freedom as possible in the design and configuration, positive mechanical properties (e.g. high impact strength), as well as specific optical properties (e.g. transparency, gloss, etc.), which are achieved in different degrees particularly by the materials listed above by way of example.

There is therefore the need to obtain the positive properties of the material and, specifically, to produce an electrically conducting surface. In particular the optical transparency and gloss are in this connection technically demanding. These can be achieved only in three ways. Either the substrate material itself is specifically made electrically conducting, without thereby adversely affecting its mechanical and optical properties, or a material is used that is conducting but is not visually recognisable by the human eye and can easily be applied in a targeted manner to the surface of the substrate, or a conducting material is used, which although itself is not transparent, can however be applied by means of a suitable process to the surface in such a way that the resulting structure is in general not perceivable by the human eye without the assistance of optical aids. In this way the properties of gloss and transparency of the substrate are not affected.

In general any structure which, when applied to a two-dimensional surface does not exceed a characteristic length of 20 μm in one of its two dimensions on the substrate plane, is regarded as visually non-recognisable. In order reliably to exclude any influencing of the surface recognition, structures in the submicron range (i.e. with a line width of ≦1 μm) are particularly desirable.

A large number of methods exist for applying in particular conducting material to surfaces. In particular conventional printing methods, such as screen printing or ink jet printing, are suitable for this purpose. Corresponding formulations for conducting materials—also termed inks—already exist particularly for these printing techniques, which in conjunction with the methods enable conducting structures to be formed on the surface.

Whereas screen printing methods on account of the very small available mesh width of the printing screen are in principle not able to produce structures with an optical resolution of less than 1 μm, ink jet printing methods for example would theoretically be suitable for this purpose, since the dimensions of the resulting structure on the substrate in the case of ink jet printing methods directly correlate to the nozzle diameter of the printing head that is used. However, in this connection the characteristic length of the minimal dimension of the resulting structure is as a rule larger than the diameter of the employed nozzle head [J. Mater. Sci 2006, 41, 4153; Adv. Mater 2006, 18, 2101]. Nevertheless, in principle structures with a line width of less than 1 μm could be produced if printers with nozzle openings of significantly less than 1 μm can be used. However, this is not feasible in practice since with increasing reduction of the nozzle diameter the requirements on the inks that can be used become much more stringent. Should the employed ink contain particles, then their mean diameter would have to match the reduction in the nozzle diameter, which in principle already excludes all inks with particles of size ≧1 μm. Furthermore, the requirements placed on the rheological properties of the ink (e.g. viscosity, surface tension, etc.) so that it can still be used for the printing head increase. In many cases these parameters cannot however be adjusted separately from the behaviour (e.g. spreading and adherence) of the ink on the respective substrate, which means that the ink and printing method combination cannot be used to produce conducting structures in this size range.

One method with which alternatively structures of size less than 1 μm can be produced on polymer surfaces is the so-called hot stamping method. By means of this method circular surface structures with a diameter of ca. 25 nm have already been produced [Appl Phys Lett 1995, 67, 3114; Adv Mater 2000, 12, 189]. The disadvantage of hot stamping however is that the structural shape is restricted to the shape of the stamping punch or stamping roller that is used in each case. A free choice in the configuration of the structure is not possible with this method. Particularly thin fibres, which potentially could also be applied to the surface of a suitable substrate, can be produced by means of a method that has become established under the name "electrospinning". In this way it is possible by using a spinnable material to produce fibres of a few nanometres in diameter [Angew Chem 2007, 119, 5770-5805].

Electrospun fibres are however obtained only in the form of large, disordered fibre mats. Up to now ordered fibres can however be obtained only by spinning on a rotating roller [Biomacromolecules, 2002, 3, 232]. It is also known that in principle electrically conducting fibres can be spun by means of "electrospinning". A corresponding conducting material for such an application utilising the conductivity of carbon nanotubes is also known [Langmuir, 2004, 20(22), 9852].

In US2001-0045547 methods and materials are disclosed, with which conducting fibre mats can be obtained.

A targeted deposition of non-conducting fibres on planar surfaces has also been achieved by reducing the distance between the spinning head and the substrate [Nano Letters, 2006, 6, 839].

Up to now no electrically conducting structures with a specific arrangement on a substrate surface have been produced by means of electrospinning.

In US2005-0287366 a method and a material are disclosed, by means of which conducting fibres can be produced. The method includes electrospinning at an interspacing of about 200 mm, with the result that disordered fibre mats are likewise obtained. The material is a polymer that is made electrically conducting by further post-treatment steps, including a thermal treatment. A targeted orientation and application of the resultant fibres to a substrate is not disclosed.

The object of the present invention is accordingly to develop a process with which, by using the electrospinning technique, conducting structures that are visually not directly recognisable by the human eye can be specifically produced on a surface.

SUMMARY OF THE INVENTION

This object is achieved by the use of an arrangement for the production of electrically conducting linear structures with a line width of at most 5 μm on an, in particular, non-electrically conducting substrate, which is the subject-matter of the invention, comprising at least one substrate holder, a spinning capillary, which is connected to a reservoir for a spinning liquid and to an electrical voltage supply, an adjustable movement unit for moving the spinning capillary and/or the substrate holder relative to one another, an optical measuring instrument, in particular a camera, for following the spinning process at the outlet of the spinning capillary, and a computing unit for regulating the distance of the spinning capillary relative to the substrate holder depending on the spinning process.

BRIEF DESCRIPTION OF THE DRAWING

FIG. 1 is a diagrammatic illustration of the spinning arrangement according to the invention.

DETAILED DESCRIPTION

Preferably the spinning capillary has an opening width of at most 1 mm, preferably 0.25-0.75 mm, particular preferably 0.3-0.5 mm. Particularly preferred is an arrangement in which the spinning capillary has a circular opening with an internal diameter of 0.01 to 1 mm, preferably 0.01 to 0.5 mm and particularly preferably 0.01 to 0.1 mm.

In a preferred implementation of the new arrangement the voltage supply source delivers an output voltage of up to 10 kV, preferably 0.1 to 10 kV, particularly preferably 1 to 10 kV and most particularly preferably 2 to 6 kV.

In a further preferred implementation the adjustable movement unit serves to move the substrate holder.

Also preferred is an arrangement which is characterised in that the spinning capillary can be adjusted to a distance of 0.1 to 10 mm, preferably 1 to 5 mm and particularly preferably 2 to 4 mm from the substrate surface.

In a particularly preferred variant of the arrangement, the reservoir for the spinning liquid is provided with a conveying device that conveys the spinning liquid to the spinning capillary. A plunger-type syringe which is provided with a motor spindle as the plunger drive is for example suitable for this purpose.

The invention also provides a method for producing electrically conducting linear structures with a line width of at most 5 μm on an, in particular, non-electrically conducting substrate by electrospinning and post treatment, characterised in that a spinning liquid containing an electrically conducting material or a precursor compound for an electrically conducting material is spun onto the substrate surface from a spinning capillary with an opening width of at most 1 mm under the application of an electrical voltage between the substrate or substrate holder and spinning capillary or spinning capillary holder of at least 100 V at an interspacing of at most 10 mm between the outlet of the spinning capillary and the surface of the substrate, and the substrate surface is moved relative to the outlet of the spinning capillary, wherein the relative movement is controlled depending on the spinning flow, followed by removal of the solvent of the spinning liquid and optionally post-treatment of the precursor compound to form an electrically conducting material.

Suitable substrates are electrically non-conducting or poorly conducting materials such as plastics, glass or ceramics, or semi-conducting substances such as silicon, germanium, gallium arsenide and zinc sulfide. In a preferred method the distance between the outlet of the spinning capillary and the substrate surface is adjusted to 0.1 to 10 mm, preferably 1 to 5 mm and particularly preferably 2 to 4 mm.

The viscosity of the spinning liquid is preferably at most 15 Pa·s, particularly preferably 0.5 to 15 Pa·s, more particularly preferably 1 to 10 Pa·s and most particularly preferably 1 to 5 Pa·s.

The spinning liquid consists preferably of at least one solvent, in particular at least one solvent selected from the group consisting of: water, $C_1$-$C_6$ alcohols, acetone, dimethylformamide, dimethyl acetamide, dimethyl sulfoxide and meta-cresol, a polymeric additive, preferably polyethylene oxide, polyacrylonitrile, polyvinylpyrrolidone, carboxymethylcellulose or polyamide, and a conducting material.

Particularly preferred is a method in which the spinning liquid contains as conducting material at least one member of the group consisting of: conducting polymer, a metal powder, a metal oxide powder, carbon nanotubes, graphite and carbon black.

Particularly preferably the conducting polymer is selected from the group consisting of: polypyrrole, polyaniline, polythiophene, polyphenylenevinylene, polyparaphenylene, polyethylenedioxythiophene, polyfluorene, polyacetylene, and mixtures thereof, particularly preferably polyethylenedioxythiophene/polystyrenesulfonic acid.

In the case where the spinning liquid preferably comprises a conducting material at least one metal powder of the metals silver, gold and copper, preferably silver, then water containing a dispersant and optionally in addition $C_1$-$C_6$ alcohol is used as solvent, in which connection the metal powder is present in dispersed form and has a particle diameter of at most 150 nm.

Preferably the dispersant includes at least one agent selected from the following list: alkoxylates, alkylolamides, esters, amine oxides, alkylpolyglucosides, alkylphenols, arylalkylphenols, water-soluble homopolymers, water-soluble random copolymers, water-soluble block copolymers, water-soluble graft polymers, in particular polyvinyl alcohols, copolymers of polyvinyl alcohols and polyvinyl acetates, polyvinyl pyrrolidones, cellulose, starch, gelatins, gelatin derivatives, amino acid polymers, polylysine, polyaspartic acid, polyacrylates, polyethylene sulfonates, polystyrene sulfonates, polymethacrylates, condensation products of aromatic sulfonic acids with formaldehyde, naphthalene sulfonates, lignin sulfonates, copolymers of acrylic monomers, polyethyleneimines, polyvinylamines, polyallylamines, poly (2-vinylpyridines), block copolyethers, block copolyethers with polystyrene blocks and/or polydiallyldimethyl ammonium chloride.

A particularly preferred spinning liquid is characterised in that the silver particles a) have an effective particle diameter of 10 to 150 nm, preferably 40 to 80 nm, measured by laser correlation spectroscopy.

The silver particles a) are preferably contained in the formulation in an amount of 1 to 35 wt. %, particularly preferably 15 to 25 wt. %.

The content of dispersant in the spinning liquid is preferably 0.02 to 5 wt. %, particularly preferably 0.04 to 2 wt. %.

The size determination by means of laser correlation spectroscopy is known in the literature and is described for example in: T. Allen, Particle Size Masurements, Vol. 1, Kluver Academic Publishers, 1999.

In another variant of the new method a spinning liquid is used which comprises a precursor compound for an electrically conducting material that is selected from the group consisting of: polyacrylonitrile, polypyrrole, polyaniline, poly-ethylenedioxythiophene and which additionally contains a metal salt, in particular an iron(III) salt, particularly preferably iron(III) nitrate. Suitable solvents are for example acetone, dimethyl acetemide, dimethylformamide, dimethyl sulfoxide, meta-cresol and water.

The method is most particularly preferably carried out in such a way that the new arrangement described above or a preferred variant thereof is used to spin the spinning liquid.

The desired fine electrically conducting structures are produced by electrospinning by means of the above arrangement. Depending on the spinning solution that is used the structures have to be post-treated in order to achieve or increase the desired conductivity.

When a voltage is applied between the capillary or capillary holder and the substrate holder, a droplet from which the spinning thread emerges is formed at the opening of the capillary.

In addition receptacles for the capillary and substrate are configured so that a relative positioning of the capillary opening with respect to the substrate surface is possible. In a preferred embodiment the capillary can be positioned above the substrate by means of adjustment motors, while in another embodiment it is possible with adjustment motors to position the substrate underneath the capillary during the spinning. Preferably the substrate is moved underneath the capillary.

In order to produce the desired conducting structures from the spinning liquid, it should be ensured that the spinning process is stabilised in such a way that the resulting structure does not exhibit any breaks/discontinuities on the surface. Preferably this is achieved by regulating the capillary distance relative to the substrate surface, in which the forward movement of the line is interrupted by means of a regulating loop depending on a camera image, if the spinning thread obviously breaks. Particularly preferably the procedure is stabilised by arranging for a computer to analyse the camera image and interrupt the relative feed movement of the capillary with respect to the substrate if the analysis shows a break in the continuous fibre.

The minimum voltage to be applied in the method varies linearly with the adjusted interspacing and also depends on the nature of the spinning liquid. Preferably an operating voltage of 0.1 to 10 kV should be employed for the spinning process so as to obtain a structured deposition of the fibres, as described above.

Particularly good results are achieved with distances between the head of the capillary and substrate surface in the range of from about 0.1 to about 10 mm. It was also found that for the implementation of the method, the material to be spun should have a viscosity of in particular at most 15 Pa·s, in order reliably to produce conducting structures with the spinning material.

After the steps described above have been carried out the specified material is present in the desired form on the substrate, and can if necessary be post-treated in order to increase the conductivity.

This post-treatment includes for example supplying energy to the produced structures. In the case of conducting polymers (in particular polyethylene dioxythiophene) the polymer particles present in suspension in the solvent are fused with one another on the substrate by for example heating the suspension, the solvent being at least partially evaporated. Preferably the post-treatment step is carried out at least at the melting point of the electrically conducting polymer, and particularly preferably above its melting point. In this way continuous conducting paths are formed. Also preferred is a post-treatment of the structures/fibres on the substrate by means of microwave radiation.

In the case of a spinning material containing carbon nanotubes, the solvent between the particles present in dispersed form is evaporated by the post-treatment of the lines that are formed, so as to obtain continuous strips of carbon nanotubes capable of percolation. The treatment step is in this connection carried out in the region of the evaporation temperature or thereabove of the solvent contained in the material, and preferably above the evaporation temperature of the solvent. When the percolation boundary is reached, the desired conducting paths are formed.

Alternatively conducting structures can also be produced by depositing a precursor material for an electrically conducting material, for example polyacrylonitrile (PAN), on the substrate and then heat treating the substrate under alternating gaseous media so as to produce carbon in the form of a conducting substance, as described hereinafter.

In this case a solution of a polymer (e.g. PAN or carboxymethylcellulose) and a metal salt (e.g. an iron(III) salt such as iron nitrate) is prepared in a solvent (e.g. dimethylformamide (DMF)) that is suitable for both components. The polymer should be able to be converted into a material which is stable and conducting at such temperatures. Particularly preferred polymers are those that can be converted to carbon by high temperature treatment. Particularly preferred are graphitisable polymers (such as for example polyacrylonitrile at 700°-1000° C.). In the case of the metal salts those are preferred whose disintegration temperature or decomposition temperature under a reductive atmosphere lie below the decomposition temperature of the respective polymer (e.g. iron(III) nitrate nonahydrate at 150° C. to 350° C.). After the conversion of the metal salts into metal particles, preferably by purely thermal disintegration or using gaseous reducing agents, particularly preferably by hydrogen, the polymer is converted into carbon in the presence of the metal particles. Finally, carbon is optionally in addition deposited from the gaseous phase onto the structures, preferably by chemical gaseous phase deposition from hydrocarbons. For this purpose volatile carbon precursors are led at high temperatures over the structures. It is preferred to use short-chain aliphatic compounds in this case, particularly preferably for example methane, ethane, propane, butane, pentane or hexane, especially preferably the aliphatic hydrocarbons n-pentane and x-hexane that are liquid at room temperature. In this case the temperatures should be chosen so that the metal particles promote the growth of tubular carbon filaments and an additional graphite layer along the fibres. In the case of iron particles this temperature range is for example between 700° and 1000° C., preferably between 800° and 850°. The duration of the gaseous phase deposition in the above case is between 5 minutes and 60 minutes, preferably between 10 minutes and 30 minutes.

If according to the preferred procedure the aforedescribed suspensions of noble metal nanoparticles in solvents are used as spinning liquid to produce conducting structures, then the post-treatment can be carried out by heating the whole structural part or specifically the conducting paths to a temperature at which the metal particles sinter together and the solvent at least partially evaporates. In this connection particle diameters as small as possible are advantageous, since in the case of nanoscale particles the sintering temperature is proportional to the particle size, with the result that with small particles a lower sintering temperature is necessary. In this connection the boiling point of the solvent is as close as possible to the sintering temperature of the particles and is as low as possible, in order thermally to protect the substrate. Preferably the solvent of the spinning liquid boils at a temperature <250° C., particularly preferably at a temperature <200° C. and most preferably at a temperature <100° C. All the temperatures specified here refer to boiling points at a pressure of 1013 hPa. The sintering step is carried out at the specified temperatures until a continuous conducting path has been formed. The duration of the sintering step is preferably 1 minute to 24 hours, particularly preferably 5 minutes to 8 hours and most particularly preferably 2 to 8 hours.

The new method can be used in particular for the production of substrates that comprise conducting structures on their surface, that in one dimension have a length of not more than 1 μm, preferably 1 μm to 50 nm, and particularly preferably 500 nm to 50 nm, in which the conducting material is preferably a suspension of conducting particles, as described above, and the substrate is preferably transparent, for example of glass, ceramics, semiconductor material or a transparent polymer as described above.

The invention is described in more detail hereinafter by way of example and with reference to FIG. 1, which shows diagrammatically the spinning arrangement according to the invention.

EXAMPLES

Example 1

Conducting Nanostructures with Carbon Nanotubes

The following apparatus (see FIG. 1) was used for spinning the spinning solution:

The holder 1 for the substrate 9, which is a silicon disc, and the metallic holder 13 for the spinning capillary 2, which is provided with a liquid reservoir 3 for the spinning solution 4 and is connected to an electrical voltage supply 5. The voltage source 5 supplies D.C. voltage up to 10 kV. The spinning capillary 2 is a glass capillary with an internal diameter of 100 Mm. The controllable adjustment motor 6 serves to move the spinning capillary 2 and the adjustment motor 6' serves to move the substrate holder 1 relative to one another so as to adjust the distance between them. The camera 7 is trained on the outlet of the spinning capillary 2 so as to follow the spinning procedure and is connected to a computer 8 with image processing software for evaluating the image data provided by the camera. The drive of the motor 6' of the substrate holder 1 is adjusted by the computer 8 depending on the outflow of the spinning solution 4 from the spinning capillary 2. A spinning solution 4 was prepared from 10 wt. % of polyacrylonitrile (PAN: mean molecular weight 210 000 g/mol) and 5 wt. % of iron(III) nitrate nonahydrate in dimethylformamide. The viscosity of the resultant solution was about 4.1 Pa·s. The spinning process was initiated at an interspacing of 0.6 mm between the capillary opening and surface of the substrate 9 at a voltage of 1.9 kV between the spinning capillary 2 and substrate 9. After the establishment of a stable fibre flow the voltage was set to 0.47 kV and the interspacing was increased to 2.2 mm. At this setting the spinning solution 4 was spun onto the surface of the substrate 9 and the substrate was moved sideways so as to form lines.

The substrate 9 together with the contained PAN fibres was next heated from 20° to 200° C. within 90 minutes, and then treated for 60 minutes at 200° C. Following this the air of the drying oven in which the sample 9 was contained was replaced by argon and the temperature was raised to 250° C. within 30 minutes. Argon was then replaced by hydrogen. The temperature was again held for 60 minutes at 250° C. under this hydrogen atmosphere. This atmosphere was then replaced once again by argon as gas for the drying oven, and the sample 9 was heated to a temperature of 800° C. within 2 hours. Finally, hexane was metered into the argon for 7 minutes and following this the sample 9 was cooled once more under argon again to room temperature. The cooling process was not regulated in this case, but was monitored until the interior of the oven had again fallen to a temperature of 20° C.

A conducting line based substantially on carbon was formed. On contacting two points on the line spaced apart by 190 μm, a resistance of 1.3 kOhm was measured. The line had a line width of ca. 130 nm.

The invention claimed is:

1. An apparatus for producing electrically conducting linear structures with a line width of at most 5 μm on the surface of a non-electrically conducting substrate, said apparatus comprising a substrate holder (1), an electrospinning capillary (2) above or below the substrate holder, said electrospinning capillary having an inlet and an outlet, the inlet being connected to a reservoir (3) for an electrospinning liquid (4), said apparatus further comprising an electrical voltage supply (5) connected to (i) the electrospinning capillary or a holder for the electrospinning capillary and (ii) connectable to the substrate holder or to a substrate on the substrate holder, an adjustable movement unit (6, 6') for moving the electrospinning capillary (2) or the holder for the electrospinning capillary and/or the substrate holder (1), a camera (7) trained on the outlet of the electrospinning capillary (2) adapted to provide image data to a computer (8) connected to said computer, said computer having image processing software and being connected to the adjustable movement unit and programmed to operate the adjustable movement unit to adjust and maintain the interspacing between the electrospinning capillary (2) and a surface of a substrate held by the substrate holder (1) in accordance with image data provided by said camera.

2. Apparatus according to claim 1, wherein the electrospinning capillary (2) has an opening width of at most 1 mm.

3. Apparatus according to claim 2, wherein the electrospinning capillary (2) has a circular opening having a diameter of 0.01 to 1 mm.

4. Apparatus according to claim 3, wherein said diameter is 0.25 to 0.75 mm.

5. Apparatus according to claim 4, wherein said diameter is 0.3 mm to 0.5 mm.

6. Apparatus according to claim 1, wherein the voltage supply (5) has the capacity to deliver an output voltage of up to 10 kV.

7. Apparatus according to claim 6, wherein said output voltage is 0.1 to 10 kV.

8. Apparatus according to claim 7, wherein said output voltage is 1 to 10 kV.

9. Apparatus according to claim 8 wherein said output voltage is 2 to 6 kV.

10. Apparatus according to claim 1, wherein the adjustable movement unit (6) serves to move the substrate holder (1).

11. Apparatus according to claim 1, wherein said interspacing is adjustable to a distance of 0.1 to 10 mm.

12. Apparatus according to claim 11, wherein said interspacing is adjustable to a distance of 1 to 5 mm.

13. Apparatus according to claim 12, wherein said interspacing is adjustable to a distance of 2 to 4 mm.

14. Apparatus according to claim 1, wherein the reservoir (3) comprises a conveying device (12), which conveys the electrospinning liquid (4) to the electrospinning capillary (2).

* * * * *